US008246134B2

(12) United States Patent
Kobayashi

(10) Patent No.: US 8,246,134 B2
(45) Date of Patent: Aug. 21, 2012

(54) INKJET RECORDING APPARATUS AND DRIVE METHOD OF INKJET RECORDING HEAD

(75) Inventor: Hideyuki Kobayashi, Tokyo (JP)

(73) Assignee: Konica Minolta IJ Technologies, Inc., Tokyo (JP)

( * ) Notice: Subject to any disclaimer, the term of this patent is extended or adjusted under 35 U.S.C. 154(b) by 297 days.

(21) Appl. No.: 12/820,293

(22) Filed: Jun. 22, 2010

(65) Prior Publication Data

US 2010/0328382 A1 Dec. 30, 2010

(30) Foreign Application Priority Data

Jun. 29, 2009 (JP) ..... 2009-153577

(51) Int. Cl.
*B41J 29/38* (2006.01)

(52) U.S. Cl. ..... 347/11

(58) Field of Classification Search ..... 347/11
See application file for complete search history.

(56) References Cited

U.S. PATENT DOCUMENTS

2009/0073207 A1* 3/2009 Takeuchi ..... 347/11

FOREIGN PATENT DOCUMENTS

| | | |
|---|---|---|
| EP | 1004441 | 5/2000 |
| JP | 4161631 | 8/2008 |
| WO | 9525011 | 9/1995 |

* cited by examiner

*Primary Examiner* — Julian Huffman
(74) *Attorney, Agent, or Firm* — Lucas & Mercanti, LLP

(57) ABSTRACT

An inkjet recording apparatus having: a recording head including a pressure generation section, a pressure chamber, and a nozzle; and a drive signal generator which generates the drive signal including a first expansion pulse, a contraction pulse, and a second expansion pulse, wherein the pulses are generated to satisfy that: a peak value position P1 of positive pressure is not more than 1.45AL from a drive signal applying start time, and |M1/P1|≧0.45, where AL represents a half of the acoustic resonance period of the pressure chamber, M1 is a first peak value of negative pressure in the pressure chamber, P1 is a peak value of a positive pressure succeeding to M1, and M2 is a peak value of a negative pressure succeeding to P1, wherein M1, P1 and M2 are values of a pressure wave generated by total effect of all the pulses.

8 Claims, 14 Drawing Sheets

INKJET RECORDING APPARATUS AND DRIVE METHOD OF INKJET RECORDING HEAD

CROSS REFERENCE TO RELATED APPLICATION

The present application is based on Japanese Patent Application No. 2009-153577 filed with Japanese Patent Office on Jun. 29, 2009, the content of which is hereby incorporated by reference.

BACKGROUND OF THE INVENTION

1. Technical Field

Present invention relates to an inkjet recording apparatus for ejection an ink droplet from a nozzle, and to a drive method of the inkjet recording head.

2. Description of the Prior Art

An inkjet recording apparatus is commonly known which records an image by ejecting a minute ink droplet from a nozzle and landing the droplet on a recording medium.

In recent years, in order to record the high quality image, technologies for high density nozzles and smaller sized ink droplets having been developed. As a method for minifying the ink droplet diameter, commonly known is a so-called Pull-Push method where a pressure chamber connecting to a nozzle opening is firstly expanded and after that contracted. According to this method, since mass of the ink droplet can be made small, dot diameter in recording is said to be minified.

As an inkjet recording apparatus utilizing this Push-Pull method, the apparatus provided with a drive section is known which applies voltage V1 for t1 time period onto a piezoelectric element to expand the volume of the pressure chamber, next applies voltage V2 for t2 time period to contract the volume of the pressure chamber, and after that applies voltage V3 for t3 time period to expand the volume of the pressure chamber (see for example Japanese Registration Patent No. 4161631, hereinafter to be called Patent Document 1).

However in a case where the pressure chamber is driven with a contraction pulse such as the one described in the above mentioned Patent Document 1, a pressure wave vibration which is generated at the edge portion of the drive pulse cannot be effectively canceled, and residual vibration remains largely. Therefore, to execute high frequency drive in this state is difficult. Further, in the Patent Document 1, a second contraction pulse is lastly applied to cancel the residual vibration. By applying the second contraction pulse, the total waveform of the pulses becomes long, which leads to decrease of the drive frequency. Further, even in the case where t2+t3=AL (AL: half of the acoustic resonance period of the pressure chamber) is satisfied without applying the second contraction pulse, as described in the Patent Document 1, the residual vibration cannot be effectively canceled, which leads to greatly decreasing the drive stability. In order to obtain sufficient drive stability, it is necessary to wait for a sufficient time period until the residual vibration decays before the next drive, which results in the decrease of drive frequency.

In view of the above mentioned problems, an objective of the present invention is to provide inkjet recording apparatus and a drive method of the inkjet recording head, which enables stable and high speed ink ejection of smaller droplet without decreasing the drive frequency.

SUMMARY OF THE INVENTION

Embodiments of inkjet recording apparatus reflecting a feature of the present invention are:

(1) An inkjet recording apparatus including: a recording head having a pressure generation section which is driven to cause a movement by application of a drive signal, a pressure chamber whose volume is expanded or contracted by the movement of the pressure generation section, and a nozzle connecting to the pressure chamber; and a drive signal generator, wherein, by an applied drive signal to the pressure generation section, a volume of the pressure chamber is expanded or contracted, and an ink droplet is ejected from the nozzle, wherein, the drive signal generator is configured to generate the drive signal including at least a first expansion pulse which expands the volume of the pressure chamber, a contraction pulse, which is applied successively to the first pulse, to contract the volume of the pressure chamber, and a second expansion pulse, which is applied successively to the contraction pulse, to expand the volume of the pressure chamber, wherein a total pressure PS caused by residual vibration of liquid in the pressure chamber with respect to time t is expressed by:

$$PS=\Sigma Pi(i)$$

$$P(i)=Vi\times\mathrm{Exp}\{-(t-ei)/\tau\}\times\mathrm{Sin}\{2\pi\times fr\times(t-ei)\}$$

where, τ represents a specific decay constant obtained from an ejection experiment, fr: 1/(2AL)

AL: ½ of the acoustic resonance period of the pressure chamber,

Vi: voltage change at an i-th edge of a drive waveform,

P(i): pressure component generated by the i-th edge of the drive waveform ei: a time when i-th edge of the drive form is generated and, t represents a time wherein, the drive signal generator is configured to generate the first expansion pulse, the contraction pulse and the second expansion pulse each having a prescribed pulse width and pulse voltage value such that the drive signal satisfies that:

a position of a peak value P1 of positive pressure is not more than 1.45AL from an applying start time of the first expansion pulse, and $$|M1/P1|\geqq 0.45,$$

where M1 is a first peak value of negative pressure in the pressure chamber caused by the first expansion pulse, P1 is a peak value of a positive pressure succeeding to the first negative peak value M1, and M2 is a peak value of a negative pressure succeeding to the positive peak value P1.

(2) The inkjet recording apparatus according to (1), wherein the drive signal generator is configured to generate the drive signal such that the peak value P1 of the positive pressure and the peak value M2 of the negative pressure satisfy the relation of |M2/P1|<0.5.

(3) The inkjet recording apparatus according to (1) or (2), the recording head is a shear mode type recording head.

(4) The inkjet recording apparatus according to any one of (1) to (3), the prescribed pulse width of the first expansion pulse is 1AL, and the pulse width of the contraction pulse is not more than 0.3AL.

(5) The inkjet recording apparatus according to any one of (1) to (4), wherein the AL is not more than 4 μs.

BRIEF DESCRIPTION OF THE DRAWINGS

These and other objects, advantages and features of the invention will become apparent from the following description thereof taken in conjunction with the accompanying drawings in which.

DETAILED DESCRIPTION OF THE PREFERRED EMBODIMENTS

The present invention will be described in detail however the present invention is not limited by the description below.

Inkjet Recording Apparatus

Figure 1:
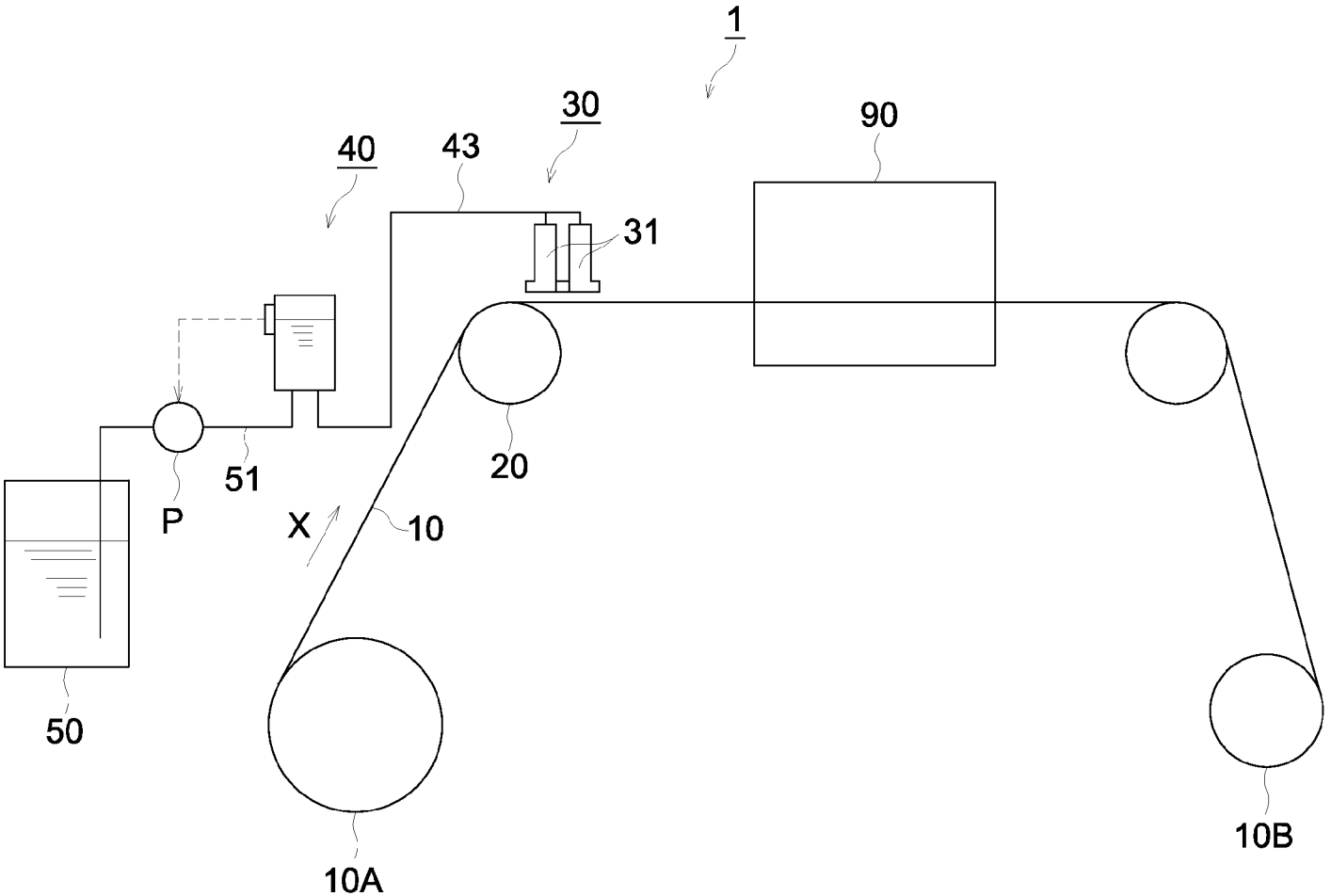
FIG. 1 is a schematic diagram showing a configuration of a line type inkjet recording apparatus.

FIG. 1 is a schematic drawing showing the configuration of the line type inkjet recording apparatus I.

As shown in FIG. 1, elongated rolled recording medium 10 is pulled-out and conveyed from rolling-out roll 10A in a direction of arrow X by unillustrated drive means. Elongated rolled recording medium 10 is conveyed while being trained and supported by back roll 20. From recording head unit 30, ink is ejected toward recording medium 10, to perform image formation based on image data. Recording head unit 30 is provided with a plurality of recording heads 31 corresponding to an ejection width in the width direction of the recording medium. Meanwhile, another configuration may also be possible where recording head 31, which is movably provided in the width direction of recording medium, ejects the ink toward recording medium 10 while moving in the width direction of the recording medium.

The ink is supplied via plural ink tubes 43 to each recording head 31 from intermediate tank 40 which adjusts a back-pressure of the ink in recording head 31. In the present embodiment, ink tube 43 in FIG. 1 represents a plurality of ink tubes. Ink supply to intermediate tank 40 is conducted by liquid sending pump P provided between reservoir tank 50 to reserve ink and supply pipe 51. Recording medium 10 on which an image has been formed is dried at drying section 90 and is rolled on take-up roll 10B.

Figure 2:
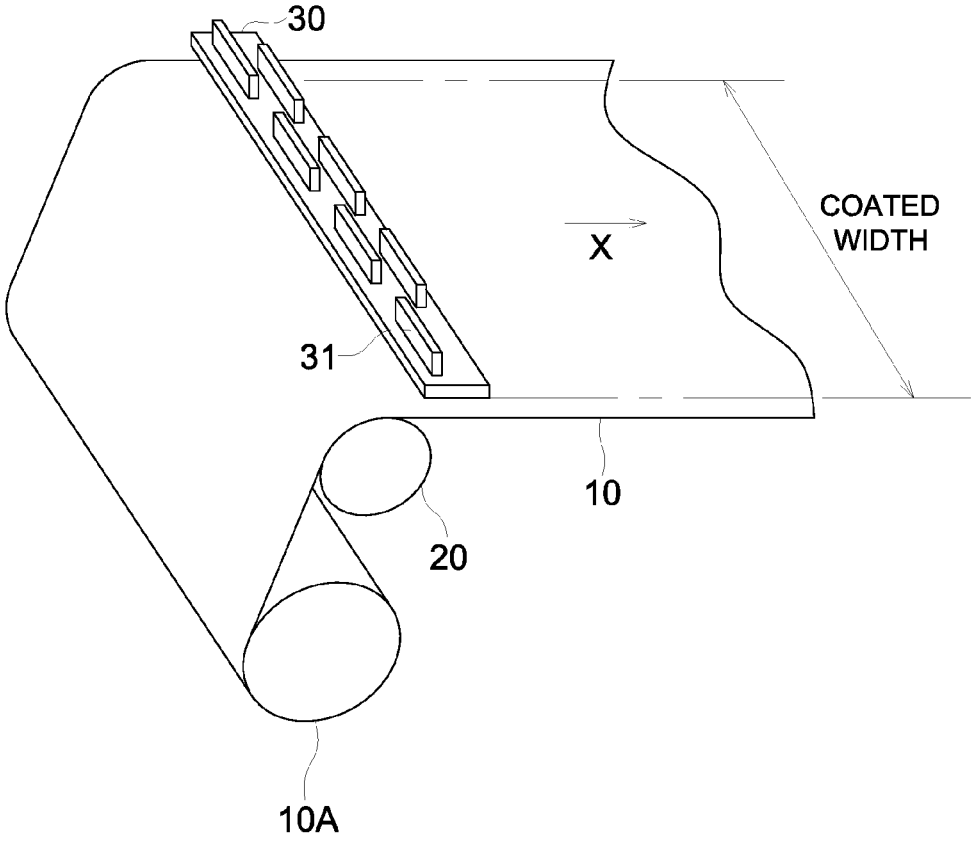
FIG. 2 is diagram showing an example of arrangement for recording heads of a recording head unit.

FIG. 2 is diagram showing an example of arrangement for recording heads 31 of a recording head unit 30.

Recording head unit 30 shown in FIG. 2 is an example where all recoding heads are arranged in positions of a same height with respect to intermediate tank 40 temporarily reserving the ink. Since an ejection width of each recording head is less than the outer shape width size of the recording head, a plurality of recording head are arranged in zigzag with respect to the conveying direction of the recording medium. In the example shown in FIG. 2, the plurality of recording heads, each corresponding to the ejection width in the width direction of recording head, are arranged in two rows zigzag arrangement.

Figure 3:
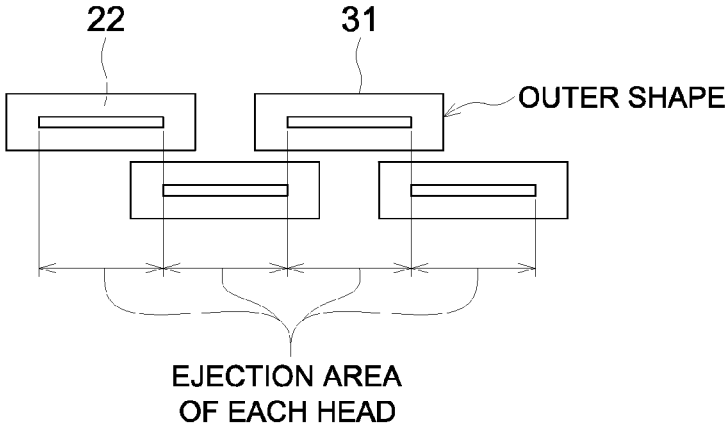
FIG. 3 is a diagram showing a relationship of outer shape, ejection width and a zigzag arrangement of a recording head.

FIG. 3 is a diagram showing a relationship of outer shape, ejection width and a zigzag arrangement of recording head 31. Since the number of recording heads 31 and the number of rows in zigzag arrangement are properly determined according to the ejection width and the like, the arrangement is not limited to that shown in FIG. 3.

Figure 4A:
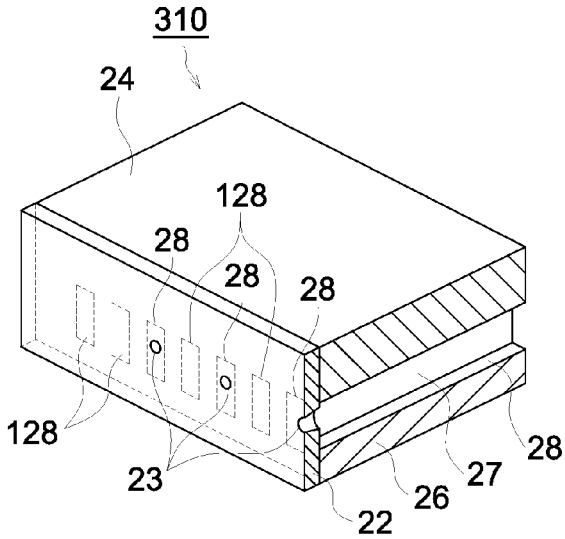
FIGS. 4*a*-4*b* are diagrams showing a recording head.
Figure 4B:
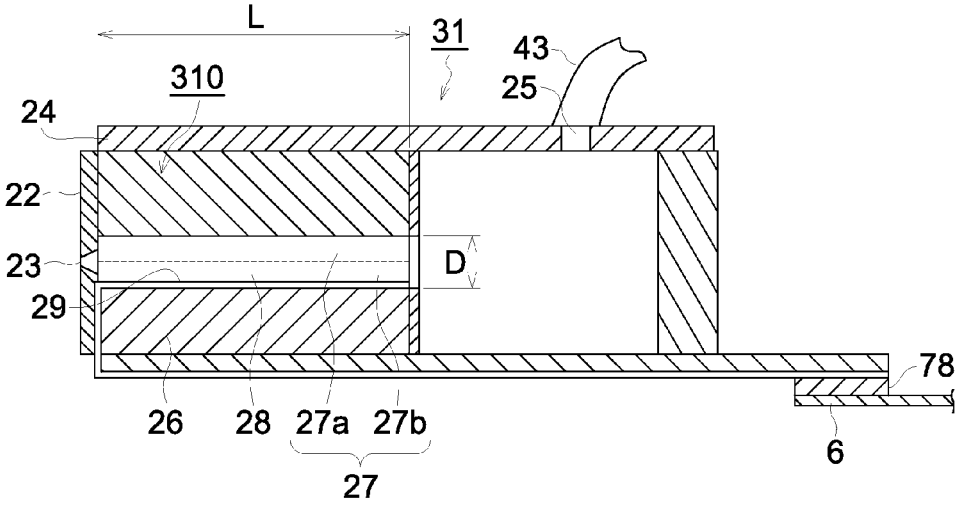

FIGS. 4*a*-4*b* are diagrams showing recording head 31. FIG. 4*a* is a perspective view showing a partial cross section of head chip 310 for shear mode type recording head 31, and FIG. 4*b* is a cross sectional view seen from a channel arrangement direction.

Figure 5A:
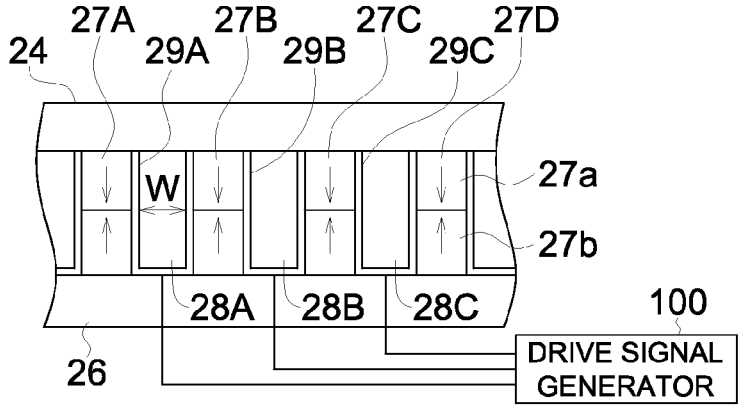
FIGS. 5*a*-5*c* are diagrams showing movements of a shear mode type recording head at the time of ink ejection.
Figure 5B:
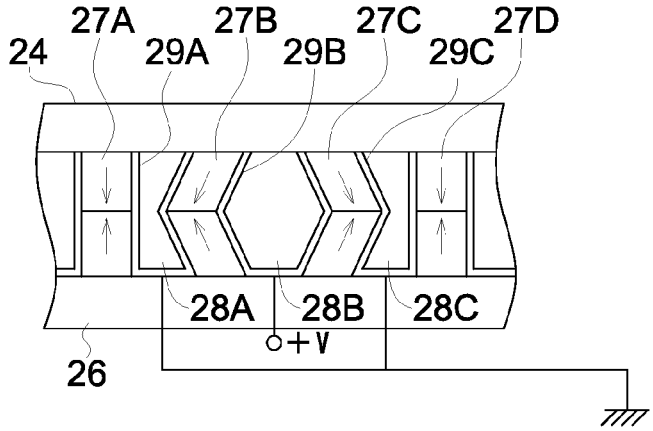
Figure 5C:
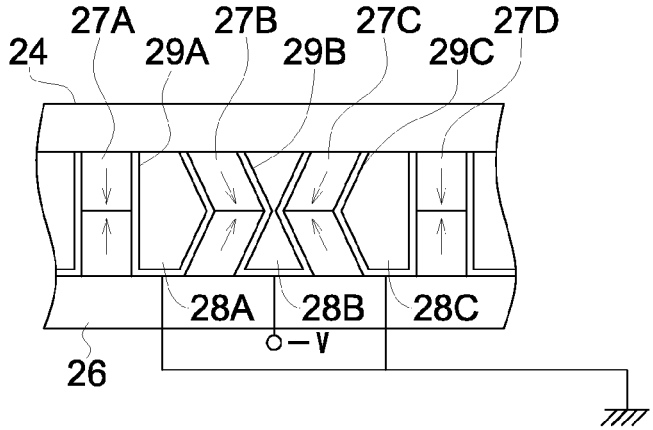

FIGS. 5*a*-5*c* are diagrams showing movements of a shear mode type recording head 31 at the time of ink ejection;

In FIG. 4, 43 is an ink tube, 22 is a nozzle forming member, 23 is a nozzle, 24 is a cover plate, 25 is a ink supply port, 26 is a substrate, 27 is a partition wall, L shows a length of a pressure chamber, D shows a depth of the pressure chamber, and W shows a width of the pressure. Pressure chamber 28 is configured with partition wall 27, cover plate 24 and substrate 26.

As shown in FIGS. 5*a*-5*c*, recording head 31 contains a plurality of pressure chambers 28 partitioned by partition walls 27A, 27B, 27C, and 27D made of piezoelectric material such as PZT which works as a pressure generation device, being arranged between cover plate 24 and substrate 26. Among said plurality of pressure chambers 28, FIGS. 5*a*-5*c* show three pressure chambers, namely 28A, 28B, and 28C. One end of pressure chamber 28 (sometimes called as "a nozzle end") is connected to nozzle 23 which is formed in nozzle forming member 22. The other end of pressure chamber 28 (sometimes called as "a manifold end") is connected to an ink tank (not shown in the drawings) with ink tube 43 via ink supply port 25. Each surface of the partition wall 27 in each pressure chamber 28 has an electrode (29A, 29B, or 29C) tightly bonded to both sides of the partition wall 27. Each of the electrodes extends from the top of partition wall 27 to the bottom of substrate 26 and is connected to drive signal generation section 100 through anisotropic conductive film 78 and flexible cable 6.

In the embodiment, each partition wall 27 is configured with two piezoelectric materials 27*a* and 27*b*, each having different polarizing directions as shown in FIGS. 5*a*-5*c*. However, the piezoelectric material can be structured, for example, with only a portion indicated by 27*a*, and can function if disposed at least on a part of partition wall 27.

Drive signal generation section 100 is configured with a drive signal generation circuit (not illustrated) which generates a series of drive pulses including a plurality of drive pulses for each pixel cycle, and a drive pulse selection circuit (not illustrated) which selects, for each pressure chamber, a drive pulse based on the image data of each pixel out of the drive signals supplied from the drive signal generation circuit. And, drive signal generation section 100 outputs a drive pulse, according to the image data of each pixel, to drive partition wall 27 of the pressure generation device.

Upon receiving the image data, the control section (not illustrated) controls a conveyance means of the recording medium, and allows the drive signal generation circuit to generate a drive signal including at least a pulse to expand the volume of pressure chamber 28 and a pulse to contract the volume of pressure chamber 28. Further, the control section outputs information of the drive pulse to be selected, to the drive pulse selection circuit, based on the image data. Thus, based on said information, the drive pulse selection circuit selects and applies the drive pulse to partition wall 27. By this process, an ink droplet can be ejected during each pixel cycle, from nozzle 23 of recording head 31.

In the inkjet recording apparatus relating to the present embodiment, for driving partition wall 27 the drive signal from drive signal generation section 100 is configured with a first expansion pulse which expands the volume of the pressure chamber 28, a contraction pulse, which is applied successively to the first expansion pulse, to contract the volume of the pressure chamber 28, and a second expansion pulse, which is applied successively to the contraction pulse, to expand the volume of the pressure chamber 28.

wherein a total pressure PS caused by residual vibration of liquid in the pressure chamber with respect to time t is expressed by:

$$PS=\Sigma Pi(i)$$

$$P(i)=Vi\times\mathrm{Exp}\{-(t-ei)/\tau\}\times\mathrm{Sin}\{2\pi\times fr\times(t-ei)\}$$

where, τ represents a specific decay constant obtained from an ejection experiment, fr: 1/(2AL)

AL: ½ of the acoustic resonance period of the pressure chamber,

Vi: voltage change at an i-th edge of a drive waveform,

P(i): pressure component generated by the i-th edge of the drive waveform ei: a time when i-th edge of the drive form is generated and, t represents a time.

wherein, the drive signal generator is configured to generate the first expansion pulse, the contraction pulse and the second expansion pulse each having a prescribed pulse width and pulse voltage value such that the drive signal satisfies that:

a position of a peak value P1 of positive pressure is not more than 1.45AL from an applying start time of the first expansion pulse, and $$|M1/P1|\geqq 0.45,$$

where M1 is a first peak value of negative pressure in the pressure chamber caused by the first expansion pulse, P1 is a peak value of a positive pressure succeeding to the first negative peak value M1, and M2 is a peak value of a negative pressure succeeding to the positive peak value P1.

In the present specification, the first expansion pulse is referred to a drive waveform to be applied before a contraction pulse which mainly contributes to actual ejection, and the second expansion pulse is referred to a drive waveform to be applied after the contraction pulse. These pulses may be applied as a step pulse with voltage change within approximately 0.5 μsec, or as a slope voltage change with a certain changing direction in relatively long time frame. These pulses can be measured and confirmed with a measuring device to display waveforms of electric signals such as an oscilloscope.

Further, before or after the above described pulse series of expansion-contraction-expansion, weak pulses for example weaker than the contraction pulse may be applied within the extent that the effect of the present invention is not detracted. For example, aiming to decap a clogged nozzle caused by viscosity increase with drying ink, so-called a swing waveform may be applied for swinging the liquid surface of the ink.

Further, in cases of sequentially ejecting, these wave forms may be applied with a cycle of such as 5AL or 6AL within the extent that the effect of the present invention is not detracted.

By driving the recording head in the above manner, the drive cycle may be made shorter, and a smaller ink droplet can be stably ejected with high speed.

Figure 6A:
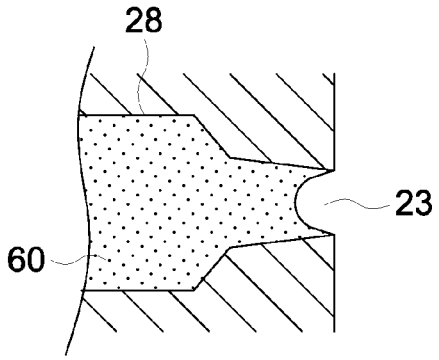
FIGS. 6*a*-6*d* are diagrams showing ejection steps of an ink droplet from a nozzle of the inkjet recording apparatus.
Figure 6B:
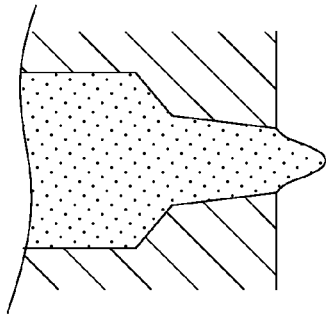
Figure 6C:
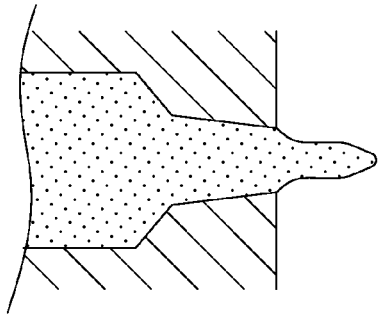
Figure 6D:
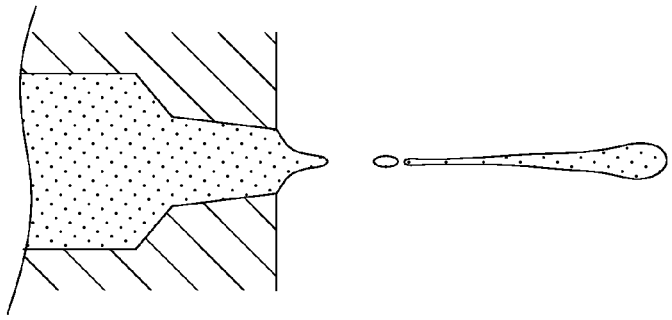

FIGS. 6*a*-6*d* show a process of ejecting an ink droplet from a nozzle of the inkjet recording apparatus. FIG. 6*a* shows the state of after 1 AL from the start of first pulse, FIG. 6*b* shows the state approximately after 1.5AL, FIG. 6*c* shows the state approximately after 2AL, and FIG. 6*d* shows the state approximately after 5AL from the start of first pulse.

Firstly, as shown in FIG. 6*a* the volume of pressure chamber 28 is expanded by an expansion pulse, and after 1AL ink 60 forms a meniscus drawn-in from a surface of nozzle 23. Next, as shown in FIG. 6*b*, after approximately 1.5AL ejection starts while a droplet is being formed. After that, as shown in FIG. 6*c*, after approximately 2.5AL ejection the formation of droplet is almost completed. And as shown in FIG. 6*d*, after approximately 5AL the ejection of droplet is completed.

According to the present embodiment, miniaturization of the liquid droplet is performed by controlling the drive pulse in such a way that the droplet is torn off in the course of ejection. To be more specific, the miniaturization of the droplet is performed by applying a pressure at the time of less than 1.5 AL to tear-off the droplet.

In order to satisfy the condition of present embodiment "a position of a peak value P1 of positive pressure is not more than 1.45AL from an applying start time of the first expansion pulse", the peak position can be controlled by firstly applying an expansion pulse with a width of approximately 1AL (AL for the subject head) to cause a sufficient negative pressure, and after contracting the pressure chamber by a contraction pulse, expanding the pressure chamber again preferably in less than ½·AL. By expanding the pressure chamber again within ½·AL from the application of the contraction pulse, the phase of pressure wave can be greatly changed and the position of the peak value P1 can be made not more than 1.3AL from the applying start time of the first expansion pulse, which enables further miniaturization of the droplet.

However, by making this interval too short, there may be a case where a time for tear off the droplet in FIG. 6*c* is too early, and the droplet column is still too thick to be torn off. Further, in this case the total pressure wave ΣP(i) becomes too small because of large phase difference between the pulses when a reversed waveform by the first expansion pulse is added to the positive pressure wave by the contraction pulse to form the total pressure wave. This also causes to make the tearing off of the droplet difficult.

Therefore, in order to obtain an aimed small liquid droplet, conditions of (i) and (ii) below needs to be concurrently satisfied:

(i) "a position of a peak value P1 of positive pressure is not more than 1.45AL from an applying start time of the first expansion pulse", and (ii) $|M1/P1| \geqq 0.45$.

Wherein, the value of $|M1/P1|$ can be controlled by varying the voltage ratio of the waveforms of the first expansion pulse and the succeeding contraction pulse. To control the value $|M1/P1|$ not less than 0.45 is possible by making the voltage ratio smaller than 2:1 and nearer to 1:1, to make the value $|M1/P1|$ gradually increase.

However, by excessively making the voltage ratio of contraction pulse large to make the voltage ratio of the pulses nearer to 1, the volume of pushed-out droplet increases, which makes it difficult to obtain the effect of liquid droplet miniaturization.

Further, it is possible to make the relation of the above mentioned positive pressure peak P1 and the negative pressure peak M2 successive to P1 to satisfy the formula of "$|M2/P1|<0.5$", by controlling the width of second expansion pulse after the above expansion-contraction to be short. In cases of making the width of second expansion pulse too long, the volume of liquid droplet becomes larger, spilling over of the liquid meniscus after ejection becomes large and high speed stable ejection cannot be attained.

According to the present embodiment, in cases of driving the inkjet head with the first expansion pulse, the contraction pulse and the second expansion pulse, by setting the contraction pulse short and applying the second expansion pulse at early timing after the contraction pulse, a negative direction wave is generated in the course of positive ejection direction wave to tear off the liquid droplet, which enables to attain the miniaturization of the droplet, and a stable high frequency drive by quickly attenuating the transient residual pressure waves.

Wherein, AL (Acoustic Length) is ½ of the acoustic resonance cycle period of the pressure wave in the pressure chamber. AL can be obtained while measuring the velocity of ink droplet ejected by applying a rectangular pulse to partition wall 27, which being an electromechanical transducer, where by varying the pulse width of the rectangular wave with keeping the voltage value of the wave constant, the pulse width which makes the maximum flying velocity of the ink droplet is obtained as the AL. The AL of the recording head of the present embodiment is 2.4 (μs), while this value is determined depending on the head structure, the viscosity of ink, and the like.

Further, a pulse is a rectangular wave having a constant pulse-height voltage, and when 0 volt is assumed to be 0% and the pulse-height voltage to be 100%, "pulse width" is defined as the interval between the point of 10% voltage in the rise or fall from the start and the point of 10% voltage in the fall or rise from the pulse-height voltage. Further, "rectangular wave" means a waveform whose rise and fall time period of respectively to 10% and 90% of the wave voltage are within ½·AL and preferably within ¼·AL.

Hereinafter, effects of the present invention will be exemplified based on examples.

EXAMPLE

Common conditions for the experiments are as follows.

Recording head: the head shown in FIGS. 4*a*-4*b* (number of nozzles; 256, nozzle diameter, 25 μm);

AL: 2.4 μs;

Ink: solvent ink (viscosity 10 mPa·s, surface tension 28 mN/m at 25° C.);

Decay constant: 7 μs;

Drive cycle period: 15 KHz; and

Drive time period: consecutive 10 sec.

Under the above conditions, ejection experiments are conducted by applying the various drive signal (drive pulse) waveforms.

The decay constant is obtained as follows.

By using the ink of the above condition, drive signal waveforms which cause the best canceling effect of the pressure wave and stable ejections are selected, and variations of the ejection velocity is measured by changing the drive cycle period from 5AL to 10AL by each 0.5AL. Further, in each drive cycle period, the most stable voltage ratio is obtained by changing the voltage ratio of the expansion pulse and the contraction pulse. As the result, the ejection velocity was most stable against the change of drive cycle period (within ±10%), namely the pressure wave was most decayed. Next, the decay constant τ which being a condition corresponding to the result of these experiments is obtained.

To be more specific, by substituting a drive signal waveform, voltage ratio, and the value of AL in the above described formula of pressure P(i) of residual vibration induced to the liquid in pressure chamber 28 with respect to time t, and by changing τ, the value of τ which caused the most effective cancel effect to the calculation result is obtained.

As the decay constant for the ink and the recording head in the present experiments described below, the value of 7 μs obtained as above is used.

Example 1

Figure 7A:
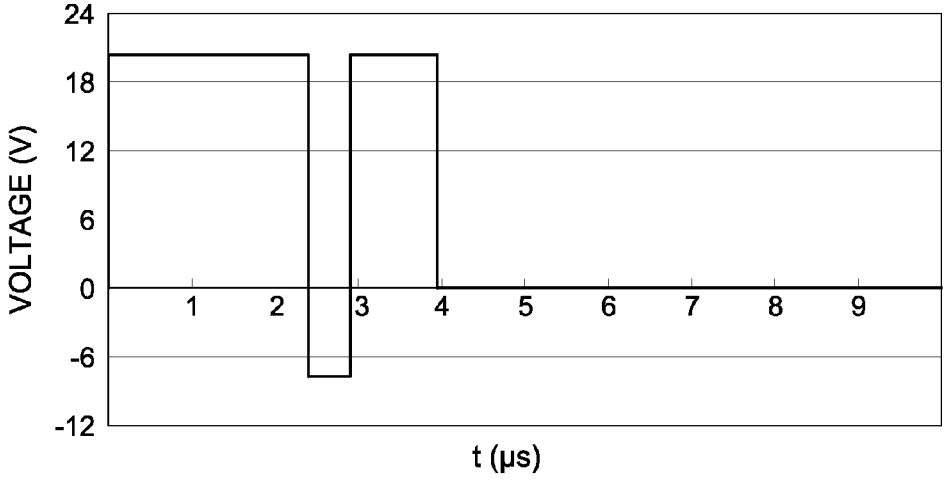
FIGS. 7*a*-7*b* are diagrams showing a drive signal waveform in example 1, and a decay of pressure waveform in the pressure chamber while the drive signal is applied.
Figure 7B:
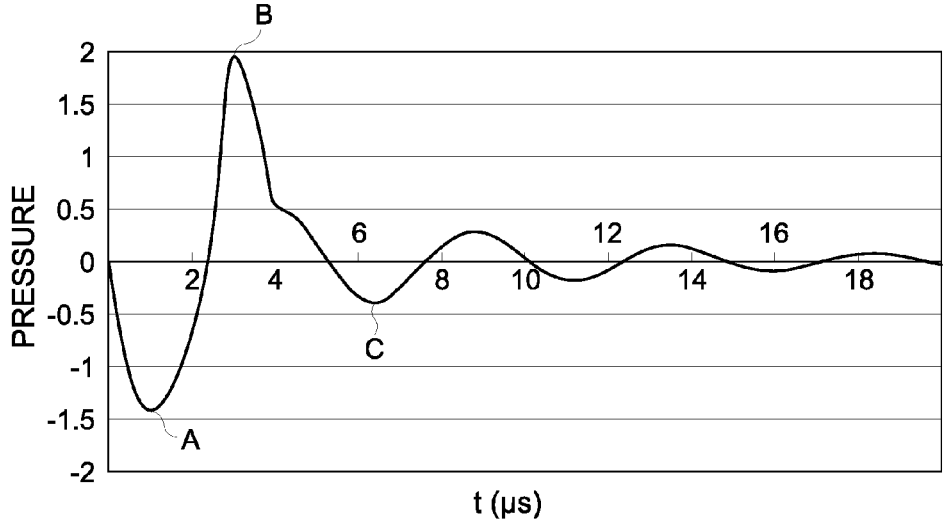

FIGS. 7*a*-7*b* are drawings respectively showing the drive signal waveform of example 1, and the decay of pressure waveform in the pressure chamber when the drive signal is applied. FIG. 7*a* shows the drive signal waveform where the horizontal axis shows a time, and the vertical axis shows a voltage value. FIG. 7*b* shows an aspect of the decay of pressure wave form in the pressure chamber while the drive signal wave form shown in FIG. 7*a* is applied.

In the drawings of FIG. 7 and later, the drawings of the drive signal waveforms regarding the time versus the voltage value show that the pulses in positive voltage sides are expansion pulses and those in negative voltage sides are contraction pulses.

In the example 1, the width of the first expansion pulse is set to be 1AL, and the width of the contraction pulse is set to be 0.2AL.

Wherein a total pressure PS caused by residual vibration of liquid in the pressure chamber with respect to time t is expressed by:

$$PS=\Sigma Pi(i)$$

$$P(i)=Vi\times\mathrm{Exp}\{-(t-ei)/\tau\}\times\mathrm{Sin}\{2\pi\times fr\times(t-ei)\}$$

where, τ represents a specific decay constant obtained from an ejection experiment, fr: 1/(2AL)

AL: ½ of the acoustic resonance period of the pressure chamber,

Vi: voltage change at an i-th edge of a drive waveform,

P(i): pressure component generated by the i-th edge of the drive waveform ei: a time when i-th edge of the drive form is generated and, t represents a time.

And the total summation ΣP(i) represents the residual pressure (pressure wave) in the pressure chamber caused by all the pulses, which is shown in the drawings, including FIG. 7*a*, of the decay of pressure waveform in the pressure chamber "A" in the drawings indicates the peak of the negative pressure caused by the first expansion pulse and this peal value is "M1". "B" indicates the peak of the positive pressure successive to the first peak of negative pressure, and this peak value is "P1", and "C" indicates the peak of the negative pressure successive to the peak "B" of positive pressure, and this peak value is "M2".

Further, in all the drawings showing the decay of pressure waveform, pressure values are indicated such that peak values P1 of the positive pressures are normalized as 2.

Example 2

Figure 8A:
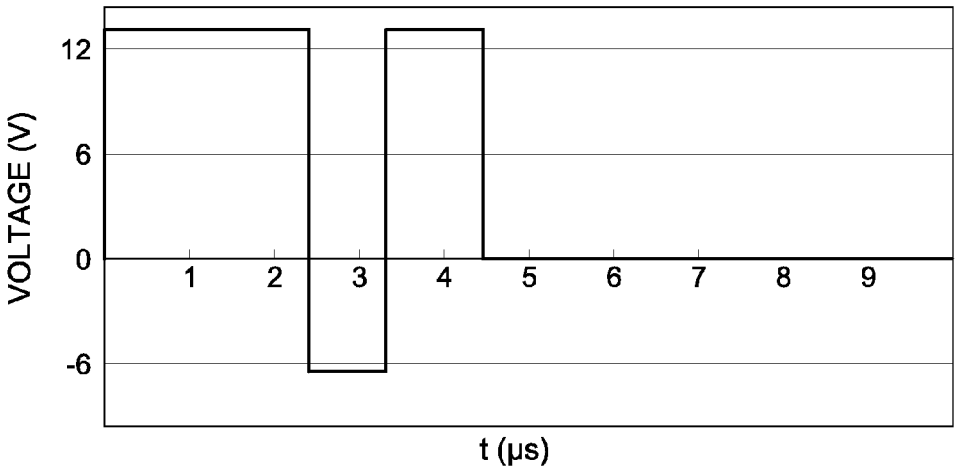
FIGS. 8*a*-8*b* are diagrams showing a drive signal waveform in example 2, and a decay of pressure waveform in the pressure chamber while the drive signal is applied.
Figure 8B:
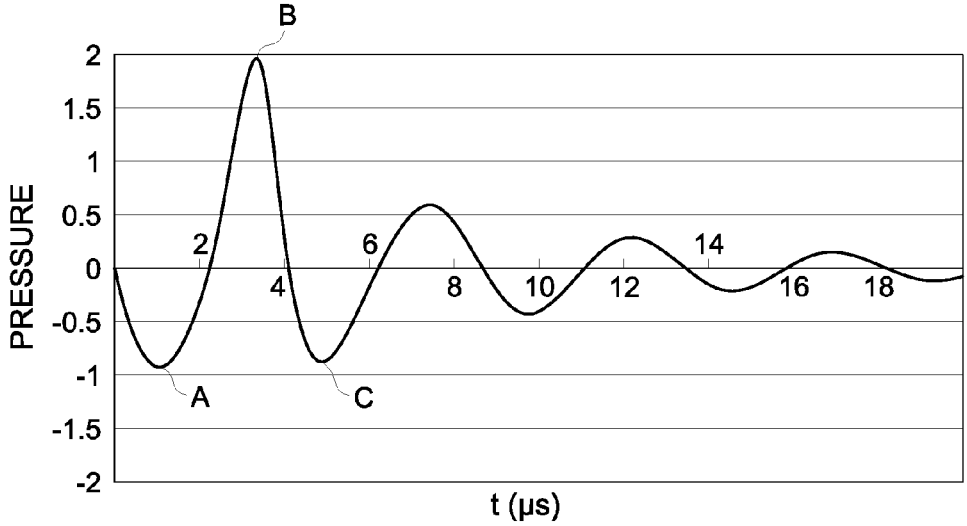

FIGS. 8*a*-8*b* are drawings respectively showing the drive signal waveform of example 2, and the decay of pressure waveform in the pressure chamber when the drive signal is applied. FIG. 8*a* shows the drive signal waveform where the horizontal axis shows a time, and the vertical axis shows a voltage value. FIG. 8*b* shows an aspect of the decay of pressure wave form in the pressure chamber while the drive signal wave form shown in FIG. 8*a* is applied.

In the example 2, the width of the first expansion pulse is set to be 1AL, and the width of the contraction pulse is set to be 0.4AL.

Example 3

Figure 9A:
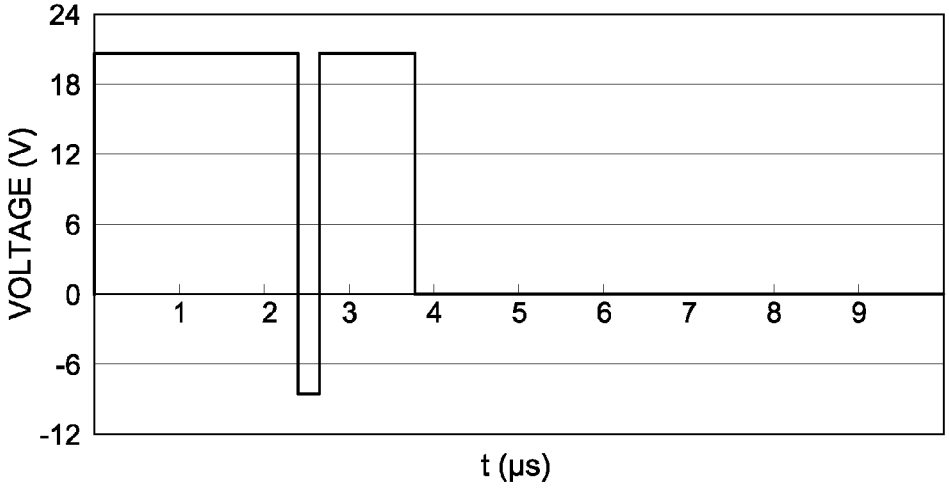
FIGS. 9*a*-9*b* are diagrams showing a drive signal waveform in example 3, and a decay of pressure waveform in the pressure chamber while the drive signal is applied.
Figure 9B:
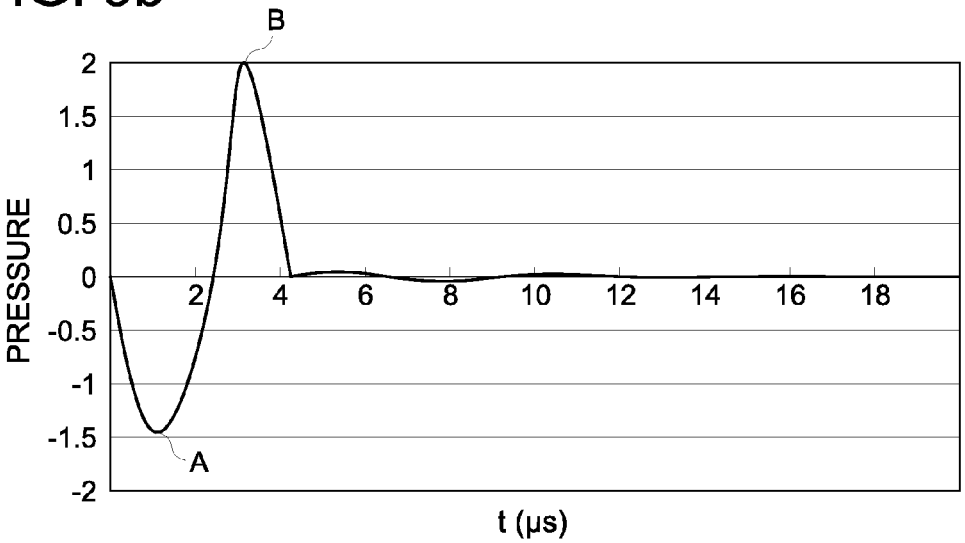

FIGS. 9*a*-9*b* are drawings respectively showing the drive signal waveform of example 3, and the decay of pressure waveform in the pressure chamber when the drive signal is applied. FIG. 9*a* shows the drive signal waveform where the horizontal axis shows a lime, and the vertical axis shows a voltage value. FIG. 9*b* shows an aspect of the decay of pressure wave form in the pressure chamber while the drive signal wave form shown in FIG. 9*a* is applied.

In the example 3, the width of the first expansion pulse is set to be 1AL, and the width of the contraction pulse is set to be 0.1AL.

Example 4

Figure 10A:
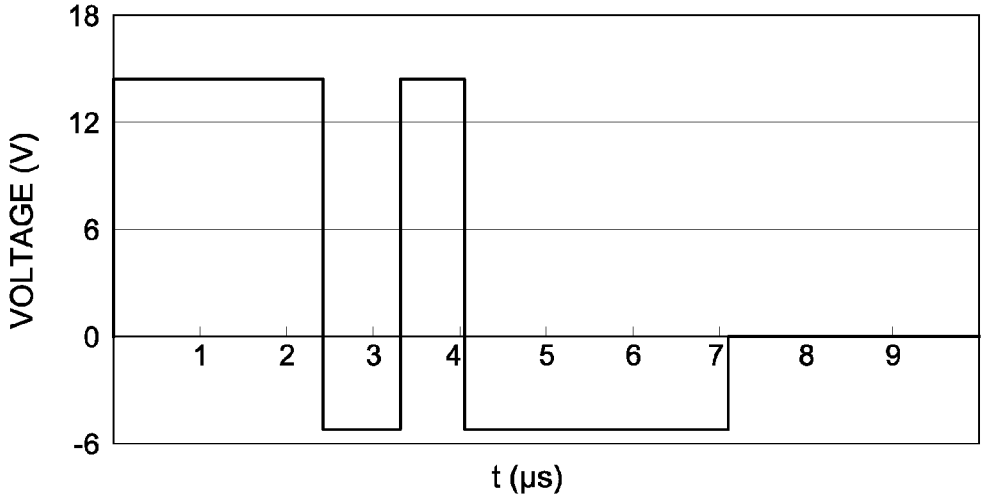
FIGS. 10*a*-10*b* are diagrams showing a drive signal waveform in example 4, and a decay of pressure waveform in the pressure chamber while the drive signal is applied.
Figure 10B:
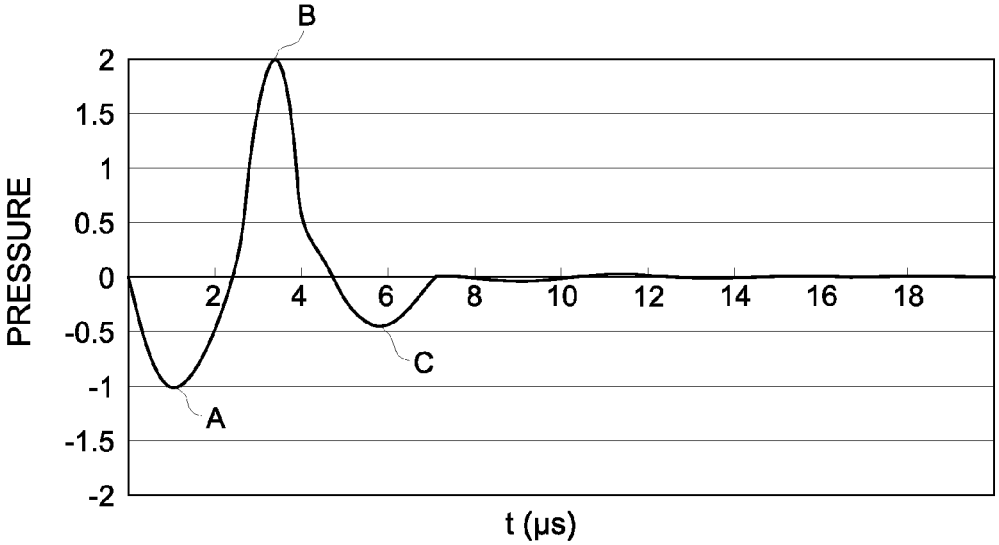

FIGS. 10*a*-10*b* are drawings respectively showing the drive signal waveform of example 4, and the decay of pressure waveform in the pressure chamber when the drive signal is applied. FIG. 10*a* shows the drive signal waveform where the horizontal axis shows a time, and the vertical axis shows a voltage value. FIG. 10*b* shows an aspect of the decay of pressure wave form in the pressure chamber while the drive signal wave form shown in FIG. 10*a* is applied.

In the example 4, the width of the first expansion pulse is set to be 1AL, the width of the contraction pulse is set to be 0.4AL, and after the second expansion pulse a contraction pulse is further added.

Comparative Example 1

Figure 11A:
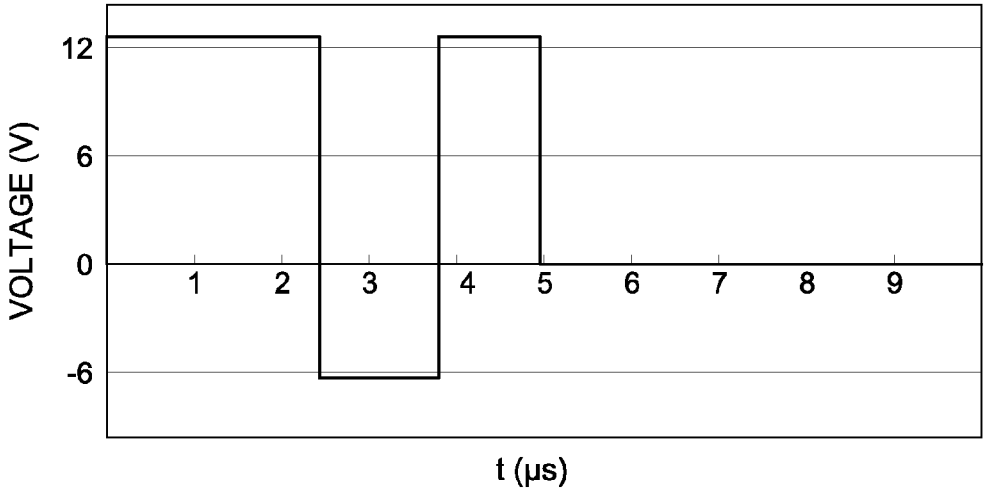
FIGS. 11*a*-11*b* are diagrams showing a drive signal waveform in comparative example 1, and a decay of pressure waveform in the pressure chamber while the drive signal is applied.
Figure 11B:
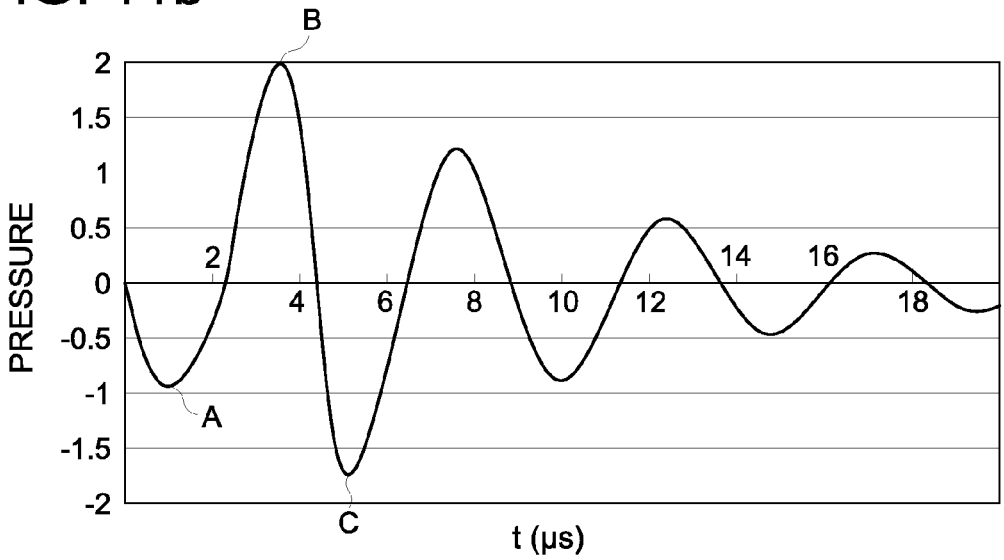

FIGS. 11*a*-11*b* are drawings respectively showing the drive signal waveform of comparative example 1, and the decay of pressure waveform in the pressure chamber when the drive signal is applied. FIG. 11*a* shows the drive signal waveform where the horizontal axis shows a time, and the vertical axis shows a voltage value. FIG. 11*b* shows an aspect of the decay of pressure wave form in the pressure chamber while the drive signal wave form shown in FIG. 11*a* is applied.

In the comparative example 1, the width of the first expansion pulse is set to be 1AL, and the width of the contraction pulse is set to be 0.6AL.

Comparative Example 2

Figure 12A:
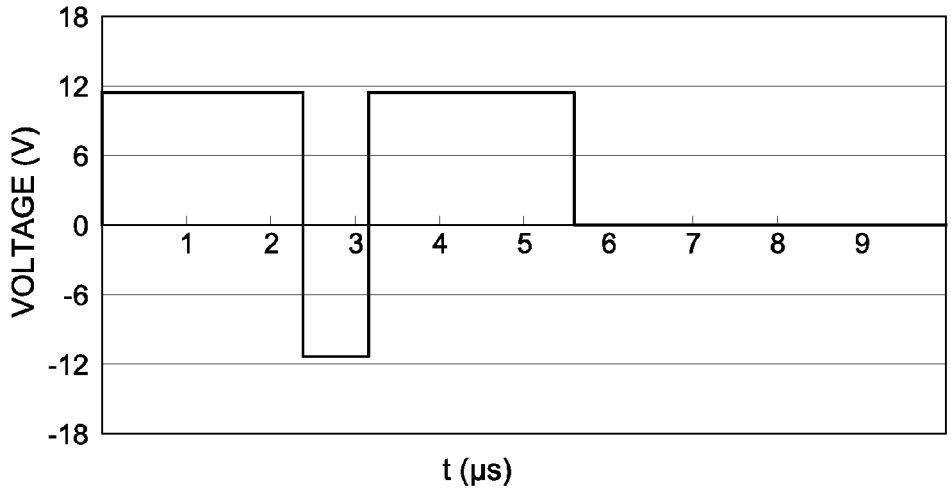
FIGS. 12*a*-12*b* are diagrams showing a drive signal waveform in comparative example 2, and a decay of pressure waveform in the pressure chamber while the drive signal is applied.
Figure 12B:
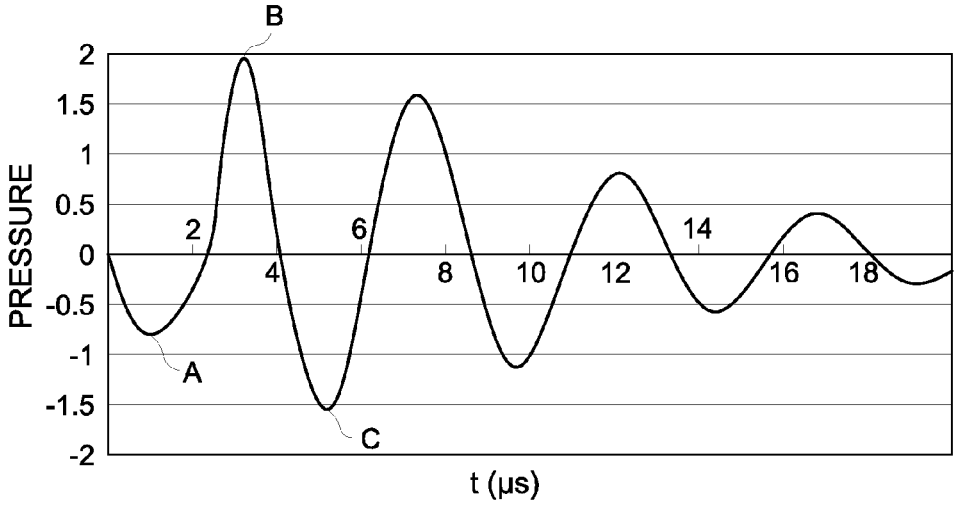

FIGS. 12*a*-12*b* are drawings respectively showing the drive signal waveform of comparative example 2, and the decay of pressure waveform in the pressure chamber when the drive signal is applied. FIG. 12*a* shows the drive signal waveform where the horizontal axis shows a time, and the vertical axis shows a voltage value. FIG. 12*b* shows an aspect of the decay of pressure wave form in the pressure chamber while the drive signal wave form shown in FIG. 12*a* is applied.

In the comparative example 2, absolute values of the expansion voltages and the contraction voltage are set as the same value, and the width of the first expansion pulse and the second expansion pulse is set to be 1AL, and the width of the contraction pulse is set to be 0.33AL.

Comparative Example 3

Figure 13A:
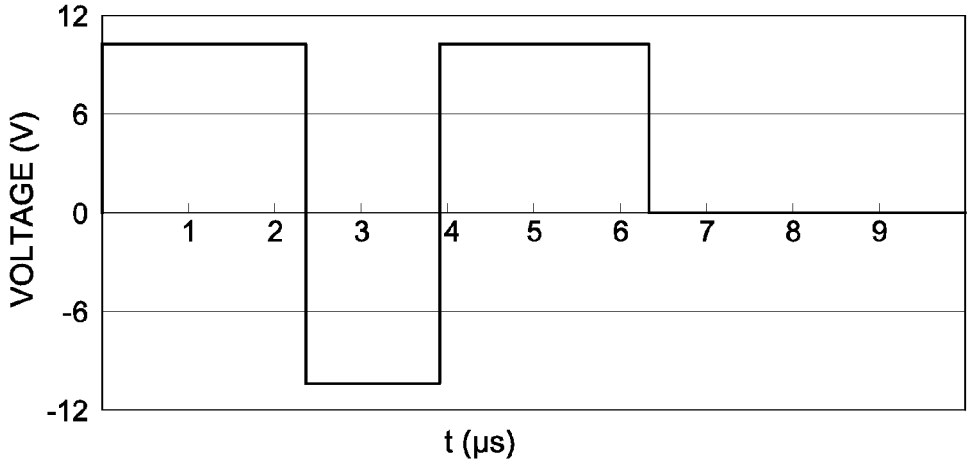
FIGS. 13*a*-13*b* are diagrams showing a drive signal waveform in comparative example 3, and a decay of pressure waveform in the pressure chamber while the drive signal is applied.
Figure 13B:
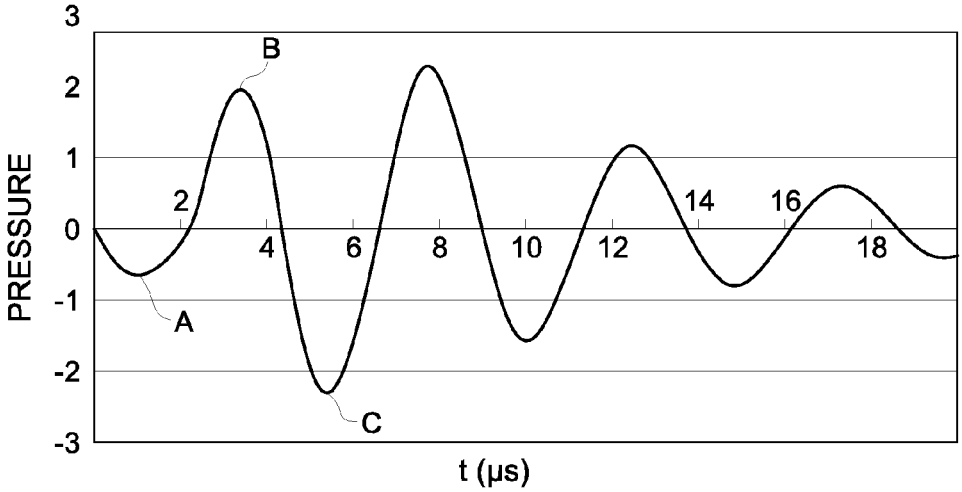

FIGS. 13*a*-13*b* are drawings respectively showing the drive signal waveform of comparative example 3, and the decay of pressure waveform in the pressure chamber when the drive signal is applied. FIG. 13*a* shows the drive signal waveform where the horizontal axis shows a time, and the vertical axis shows a voltage value. FIG. 13*b* shows an aspect of the decay of pressure wave form in the pressure chamber while the drive signal wave form shown in FIG. 13*a* is applied.

In the comparative example 3, absolute values of the expansion voltages and the contraction voltage are set as the same value, and the width of the first expansion pulse and the second expansion pulse is set to be 1 AL, and the width of the contraction pulse is set to be 0.66AL.

Comparative Example 4

Figure 14A:
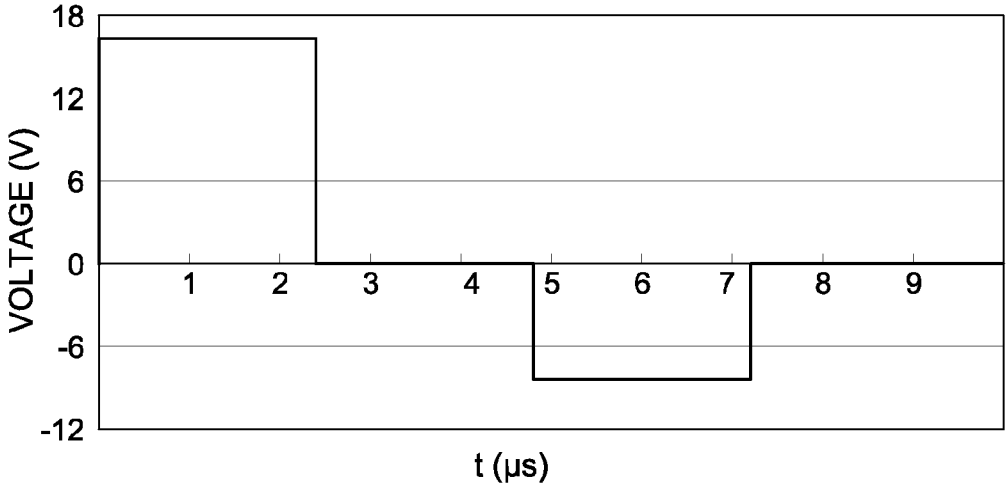
FIGS. 14*a*-14*b* are diagrams showing a drive signal waveform in comparative example 4, and a decay of pressure waveform in the pressure chamber while the drive signal is applied.
Figure 14B:
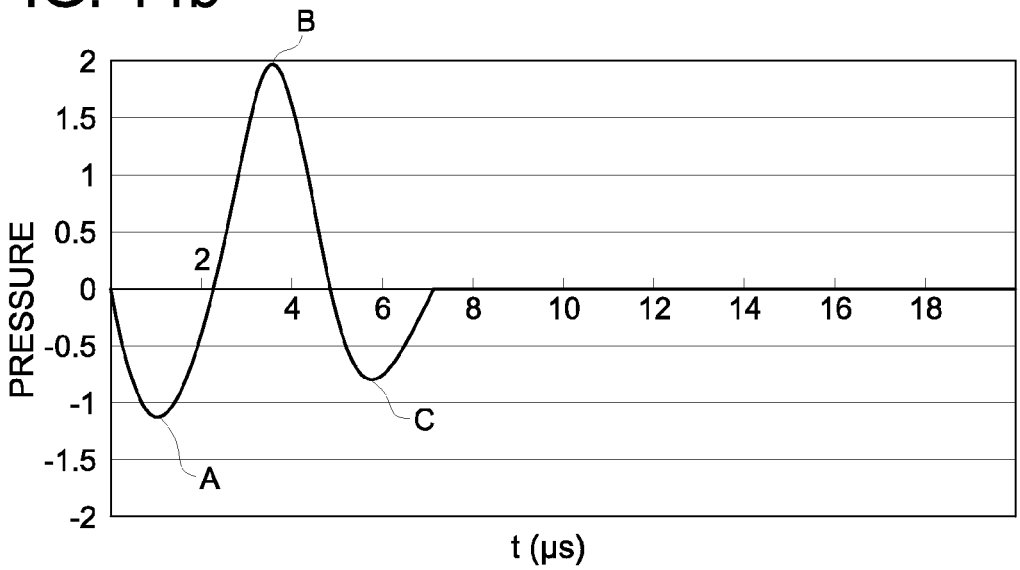

FIGS. 14*a*-14*b* are drawings respectively showing the drive signal waveform of comparative example 4, and the decay of pressure waveform in the pressure chamber when the drive signal is applied. FIG. 14*a* shows the drive signal waveform where the horizontal axis shows a time, and the vertical axis shows a voltage value. FIG. 14*b* shows an aspect of the decay of pressure wave form in the pressure chamber while the drive signal wave form shown in FIG. 14*a* is applied.

In the comparative example 4, the expansion pulse and the contraction pulse are respectively applied only once, each width of the expansion pulse and the contraction pulse is set to be 1AL, and no-voltage apply period of 1.5AL is inserted between the expansion pulse and the contraction pulse, so that the negative pressure peak successive to the positive pressure peak is cancelled by the contraction pulse.

Comparative Example 5

Figure 15A:
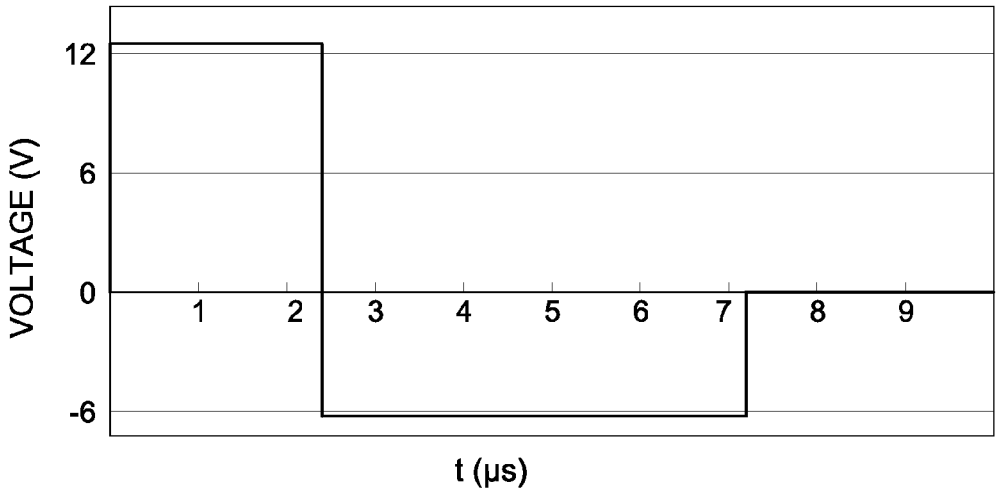
FIGS. 15*a*-15*b* are diagrams showing a drive signal waveform in comparative example 5, and a decay of pressure waveform in the pressure chamber while the drive signal is applied.
Figure 15B:
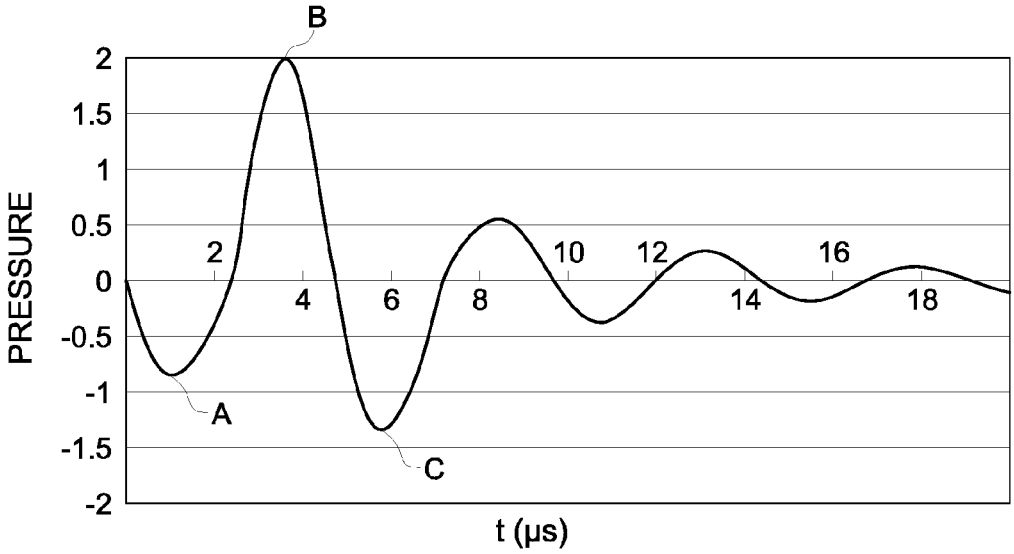

FIGS. 15*a*-15*b* are drawings respectively showing the drive signal waveform of comparative example 5, and the decay of pressure waveform in the pressure chamber when the drive signal is applied. FIG. 15*a* shows the drive signal waveform where the horizontal axis shows a time, and the vertical axis shows a voltage value. FIG. 15*b* shows an aspect of the decay of pressure wave form in the pressure chamber while the drive signal wave form shown in FIG. 15*a* is applied.

In the comparative example 5, the expansion pulse and the contraction pulse are applied in succession each one time, width of the expansion pulse is set to be 1AL and the contraction pulse is set to be 2AL, and the ratio of the absolute voltage values of the expansion pulse and the contraction pulse is set to be 2:1.

Results of the examples 1-4 and the comparative examples 1-5 are collectively shown in Table 1.

In Table 1, M1 and M2 are respectively shown by normalizing the values so that the positive pressure peak values P1 become 2.

Further, volume of the liquid droplet is obtained by measuring the ink volume gathered through the droplet ejections by the above conditions, and converting the measured volume to a droplet volume per 1 dot. As for the evaluation criteria of the droplet volume, the volume of 3 pl or less is ranked to be (A), the volume exceeding 3 pl is ranked to be (D).

Further, as for the evaluation criteria of high speed stability, the rate of un-ejected number of times is calculated by executing the ejection of 150,000 times with the drive cycle period and drive time in the above described conditions. As for the evaluation criteria, the case of 0% of un-ejected number of times is ranked to be (A), less than 1% ranked to be (B), 1% to less than 5% is ranked to be (C), and 5% or more is ranked to be (D).

TABLE 1

| | P1 peak position (μs) | P1 peak position (AL) | M1 | P1 | \|M1/P1\| | M2 | \|M2/P1\| | Droplet volume (pl) (evaluation) | High speed stability evaluation |
|---|---|---|---|---|---|---|---|---|---|
| Example 1 | 3.0 | 1.25 | −1.48 | 2 | 0.74 | −0.41 | 0.21 | 2.0 (A) | A |
| Example 2 | 3.3 | 1.38 | −0.93 | 2 | 0.46 | −0.85 | 0.43 | 3.0 (B) | B |
| Example 3 | 3.0 | 1.25 | −1.46 | 2 | 0.73 | 0 | 0 | 2.0 (A) | A |
| Example 4 | 3.3 | 1.38 | −1.01 | 2 | 0.55 | −0.45 | 0.23 | 2.4 (A) | A |
| Comparative example 1 | 3.6 | 1.50 | −0.90 | 2 | 0.45 | −1.67 | 0.83 | 3.5 (D) | D |
| Comparative example 2 | 3.2 | 1.33 | −0.78 | 2 | 0.39 | −1.50 | 0.75 | 3.6 (D) | C |
| Comparative example 3 | 3.6 | 1.50 | −0.72 | 2 | 0.36 | −2.40 | 1.20 | 3.9 (D) | D |
| Comparative example 4 | 3.6 | 1.50 | −1.14 | 2 | 0.57 | −0.79 | 0.39 | 4.0 (D) | B |
| Comparative example 5 | 3.6 | 1.50 | −0.88 | 2 | 0.44 | −1.38 | 0.69 | 4.8 (D) | C |

As shown in Table 1, in cases where both conditions of (i) the position of a peak value P1 of positive pressure is not more than 1.45AL, and (ii) |M1/P1|≧0.45 are satisfied, both effects of stable high-speed ejection and miniaturization of liquid droplet are attained.

Further, by observing the results of examples 1-4 under the above-described conditions, it can be understood that in cases where the relationship of peak value P1 of the positive pressure and peak value M2 of the negative pressure satisfies |M2/P1|<0.5 and more preferably |M2/P1|<0.3, further effects of stable high-speed ejection and miniaturization of liquid droplet are attained.

According to the present invention, it is possible to provide an inkjet recording apparatus and a drive method of the inkjet recording head, which enables stable and high speed ejection of smaller ink droplet without decreasing the drive frequency.

What is claimed is:

1. An inkjet recording apparatus comprising:

a recording head comprising a pressure generation section which is driven to cause a movement by application of a drive signal, a pressure chamber whose volume is expanded or contracted by the movement of the pressure generation section, and a nozzle connecting to the pressure chamber; and a drive signal generator, wherein by an applied drive signal to the pressure generation section, a volume of the pressure chamber is expanded or contracted to eject an ink droplet from the nozzle, wherein, the drive signal generator is configured to generate the drive signal including at least a first expansion pulse which expands the volume of the pressure chamber, a contraction pulse, which is applied successively to the first pulse, to contract the volume of the pressure chamber, and a second expansion pulse, which is applied successively to the contraction pulse, to expand the volume of the pressure chamber, wherein a total pressure PS caused by residual vibration of liquid in the pressure chamber with respect to time t is expressed by.

$$PS=\Sigma Pi(i)$$

$$P(i)=Vi\times\mathrm{Exp}\{-(t-ei)/\tau\}\times\mathrm{Sin}\{2\pi\times fr\times(t-ei)\}$$

where, τ represents a specific decay constant obtained from an ejection experiment, fr: 1/(2AL)

AL: ½ of the acoustic resonance period of the pressure chamber,

Vi: voltage change at an i-th edge of a drive waveform,

P(i): pressure component generated by the i-th edge of the drive waveform ei: a time when i-th edge of the drive form is generated and, t represents a time;

wherein, the drive signal generator is configured to generate the first expansion pulse, the contraction pulse and the second expansion pulse each having a prescribed pulse width and pulse voltage value such that the drive signal satisfies that:

a position of a peak value P1 of positive pressure is not more than 1.45AL from an applying start time of the first expansion pulse, and $$|M1/P1|\geqq 0.45,$$

where M1 is a first peak value of negative pressure in the pressure chamber caused by the first expansion pulse, P1 is a peak value of a positive pressure succeeding to the first negative peak value M1, and M2 is a peak value of a negative pressure succeeding to the positive peak value P1.

2. The inkjet recording apparatus of claim 1, wherein the drive signal generator is configured to generate the drive signal such that the peak value P1 of the positive pressure and the peak value M2 of the negative pressure satisfy the relationship of $|M2/P1|<0.5$.

3. The inkjet recording apparatus of claim 1, wherein the recording head is a shear mode type recording head.

4. The inkjet recording apparatus of claim 1, wherein the prescribed pulse width of the first expansion pulse is 1AL, and the prescribed pulse width of the contraction pulse is not more than 0.3AL.

5. The inkjet recording apparatus of claim 1, wherein the AL is not more than 4 μs.

6. A drive method of an inkjet recording apparatus which comprises: a recording head comprising a pressure generation section which is driven to cause a movement by application of a drive signal, a pressure chamber whose volume is expanded or contracted by the movement of the pressure generation section, and a nozzle connecting to the pressure chamber; and a drive signal generator; the drive method comprising the steps of:

generating the drive signal including at least a first expansion pulse which expands the volume of the pressure chamber, a contraction pulse, which is applied successively to the first pulse, to contract the volume of the pressure chamber, and a second expansion pulse, which is applied successively to the contraction pulse, to expand the volume of the pressure chamber, wherein a total pressure PS caused by residual vibration of liquid in the pressure chamber with respect to time t is expressed by:

$$PS=\Sigma Pi(i)$$

$$P(i)=Vi\times\mathrm{Exp}\{-(t-ei)/\tau\}\times\mathrm{Sin}\{2\pi\times fr\times(t-ei)\}$$

where, τ represents a specific decay constant obtained from an ejection experiment, fr: 1/(2AL)

AL: ½ of the acoustic resonance period of the pressure chamber,

Vi: voltage change at an i-th edge of a drive waveform,

P(i): pressure component generated by the i-th edge of the drive waveform ei: a time when i-th edge of the drive form is generated and, t represents a time, wherein, the drive signal generator is configured to generate the first expansion pulse, the contraction pulse and the second expansion pulse each having a prescribed pulse width and pulse voltage value such that the drive signal satisfies that:

a position of a peak value P1 of positive pressure is not more than 1.45AL from an applying start time of the first expansion pulse, and $$|M1/P1|\geqq 0.45,$$

where M1 is a first peak value of negative pressure in the pressure chamber caused by the first expansion pulse, P1 is a peak value of a positive pressure succeeding to the first negative peak value M1, and M2 is a peak value of a negative pressure succeeding to the positive peak value P1; and applying the drive signal to the pressure generation section to eject an ink droplet from the nozzle.

7. The drive method of claim 6, wherein the drive signal is generated such that the peak value P1 of the positive pressure and the peak value M2 of the negative pressure satisfy the relationship of $|M2/P1|<0.5$.

8. The drive method of claim 6, wherein the prescribed pulse width of the first expansion pulse is 1AL, and the prescribed pulse width of the contraction pulse is not more than 0.3AL.

* * * * *